US006230599B1

(12) United States Patent
Seay et al.

(10) Patent No.: US 6,230,599 B1
(45) Date of Patent: May 15, 2001

(54) PAPER SHEET PUNCH FOR SHEET POST PROCESSING MACHINES

(75) Inventors: James R Seay, Lake Forest; Peter M. Coombs, Tustin, both of CA (US)

(73) Assignee: Gradco (Japan) Ltd., Tokyo (JP)

( * ) Notice: Subject to any disclaimer, the term of this patent is extended or adjusted under 35 U.S.C. 154(b) by 0 days.

(21) Appl. No.: 09/438,272

(22) Filed: Nov. 12, 1999

(51) Int. Cl.[7] ..... B26D 5/16
(52) U.S. Cl. ..... 83/628; 83/622
(58) Field of Search ..... 83/622, 628; 227/27; 270/58.07; 399/407

(56) References Cited

U.S. PATENT DOCUMENTS 4,065,990 * 1/1978 Edhlund ..... 83/628
5,253,030 * 10/1993 Shigemura et al. ..... 83/622

* cited by examiner

*Primary Examiner*—W. Donald Bray
(74) *Attorney, Agent, or Firm*—Newton H. Lee, Jr.

(57) ABSTRACT

A punch is disclosed in which cams at the opposite ends of a rotary shaft move a spring returned mechanism so as to apply a force to a number of punches which are aligned across a pressure plate and movable towards a die plate for punching sheets of paper fed between the pressure plate and the die plate upon each revolution of the shaft and the cams, the punches being formed and supported by the pressure plate so as to progressively enter the sheet of paper to allow for a reduction in the motor force required for performing a punching operation.

3 Claims, 4 Drawing Sheets

PAPER SHEET PUNCH FOR SHEET POST PROCESSING MACHINES

FIELD OF THE INVENTION

The present invention relates to the provision of means for automatically punching sheets of paper as they are fed, one by one, into a sheet post processing machine from a printing or copying machine.

BACKGROUND OF THE INVENTION

The art of punching sheets of paper for assembly into booklets or binders is highly developed.

Examples in the prior art include Glaeser patent U.S. Pat. No. 1,739,572, granted Dec. 10, 1929 in which a pair of holes or three holes can be punched into a sheet or plurality of sheets by manually depressing cylindrical punches, which are spring loaded to an upward position, to force the punches into a die plate so as to form punched holes in the paper.

Particularly, in recent years, with the advent of sheet post processing devices which are employed in association with printers and copiers for feeding sheets of paper serially to form sets of paper, it has become the practice to include automatic means for punching the sheet with two or more holes, as the sheet is moved into the post processing unit from the printer or copier.

Such a post processing machine, for example, is shown in Muramatu et al patent U.S. Pat. No. 4,988,030 granted Jan. 29, 1991 wherein a photocopying machine supplies sheets which are punched and stapled before delivery to a paper receiving tray.

Shigemura et al patent U.S. Pat. No. 5,253,030 granted Oct. 12, 1993 shows another form of apparatus as the sheets are post processed. As disclosed in this patent, a number of punches are arranged transversely of the sheet path between a plate which defines a guide for the punches and a second plate which defines a die for each of the punches. The punches are cam actuated and individually spring loaded to an upper position. Also in this construction, the punch actuating cams are mounted upon a common shaft and sequentially cause the punches to be driven through the paper and into the respective die holes thereby delaying the timing of the punching action of the punches to relieve the load on the drive system.

Various other punching systems are known enabling the sheet to be punched on the fly between opposed rotary dies and punches, by moving the punch assembly along with the sheet or by temporarily halting movement of the sheet in the punch assembly.

SUMMARY OF THE INVENTION

The present invention relates to a punch construction in which the sheets of paper are delivered from a copier or printer between a pair of pressure applying and die plates by a pair of cams mounted on a common drive shaft which moves a pair of cam followers disposed in spaced relation and wherein the shaft is spring loaded to retract the punches as permitted by the camming action and wherein the punches are of different lengths so as to reduce the load on the drive system during the punching operation.

An object of the invention is to provide simple punching structure, including sheet infeeding means and sheet outfeeding drive rolls, wherein the rolls can be temporarily halted, causing the sheet of paper to momentarily buckle upstream of the feed direction during the punching operations as the forward motion of the sheet is temporarily halted.

Other objects and advantages of the invention will be recognized or will be described in the following description of the drawings forming a part of this application.

DESCRIPTION OF THE PREFERRED EMBODIMENT

Figure 1:
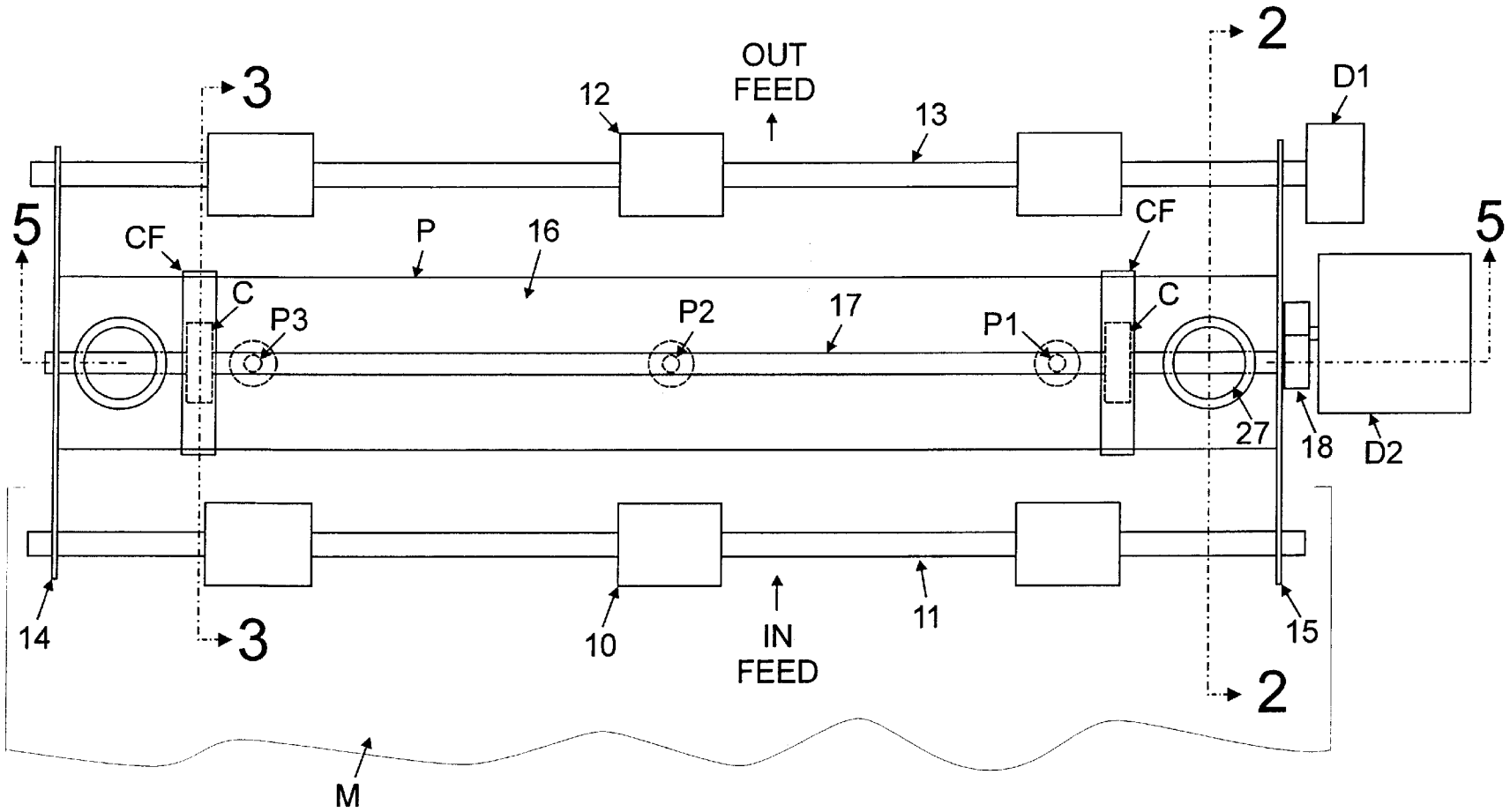
FIG. 1 is a top plan showing the punching apparatus associated with a copying or printing machine.

The structure of the punching device of the invention is adapted to be extended horizontally across the infeed path of papers exiting a printer or copier and to transport the sheet to infeed rollers 10 on an infeed shaft 11 through the punch assembly P to outfeed rollers 12 on outfeed shaft 13. These shafts 11 and 13 are journaled in end walls 14 and 15 and are adapted to be driven in unison by drive means D1. The drive means is adapted to be stopped momentarily during the punching operation described below. As shown in part, the infeed rollers 10 and shaft 11 may be incorporated in the printing or copying machine M.

A series of, shown as three, punches P1, P2 and P3 are supported in a vertically movable punch or pressure plate 16 vertically movable and extending between the end walls 14 and 15. A cam shaft 17 is journaled in the end walls 14 and 15 and supports, at its opposite ends, a pair of cams C and cam followers CF. The cam shaft is rotated by suitable gearing 18 and a drive motor D2.

Figure 2:
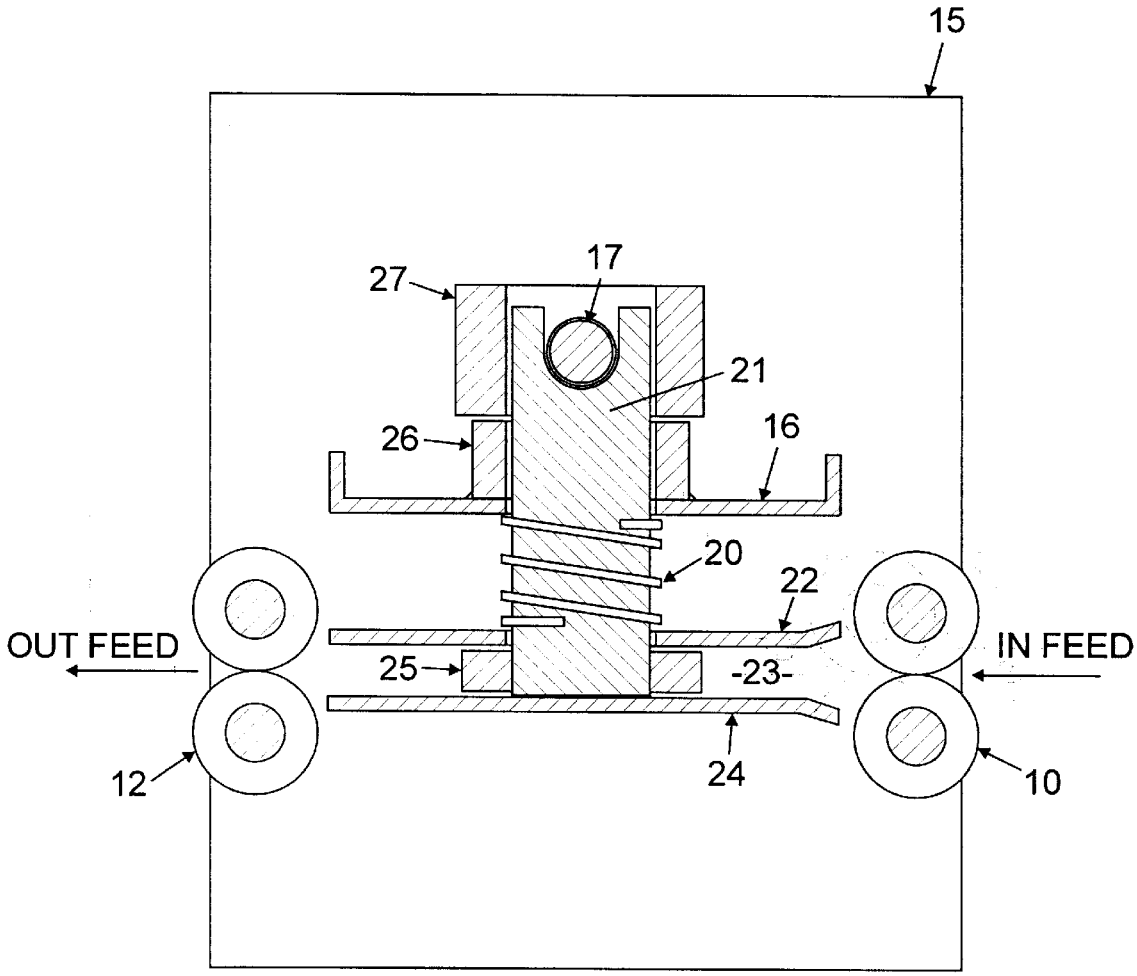
FIG. 2 is a vertical section on the line 2—2 of FIG. 1.

Referring to FIG. 2, it will be seen that between the cams C and the end walls 14 and 15, at opposite ends of the cam shaft 17, there is provided a spring loading mechanism for normally moving punch pressure plate 16 upwardly. As shown, the spring loading mechanism includes a coiled compression spring 20 disposed about a supporting post 21 and compressively engaged between the punch pressure plate 16 and a plate 22 which is the upper plate of a guide path 23 between plate 22 and a lower die plate 24 through which sheets of the paper are moved by the copier or printer to the infeed and from the outfeed between the rollers 10 and 12. At its lower end the post 21 is supported in suitable spacers 25 between the feed path plates 22 and 24.

The punch plate 16 is vertically shiftably supported upon the support posts 21 on bushings 26 and upward movement of the bushings 26 is limited by annular bearing members 27 mounted on the cam shaft 17 and forming a low friction bearing for the shaft.

Figure 3:
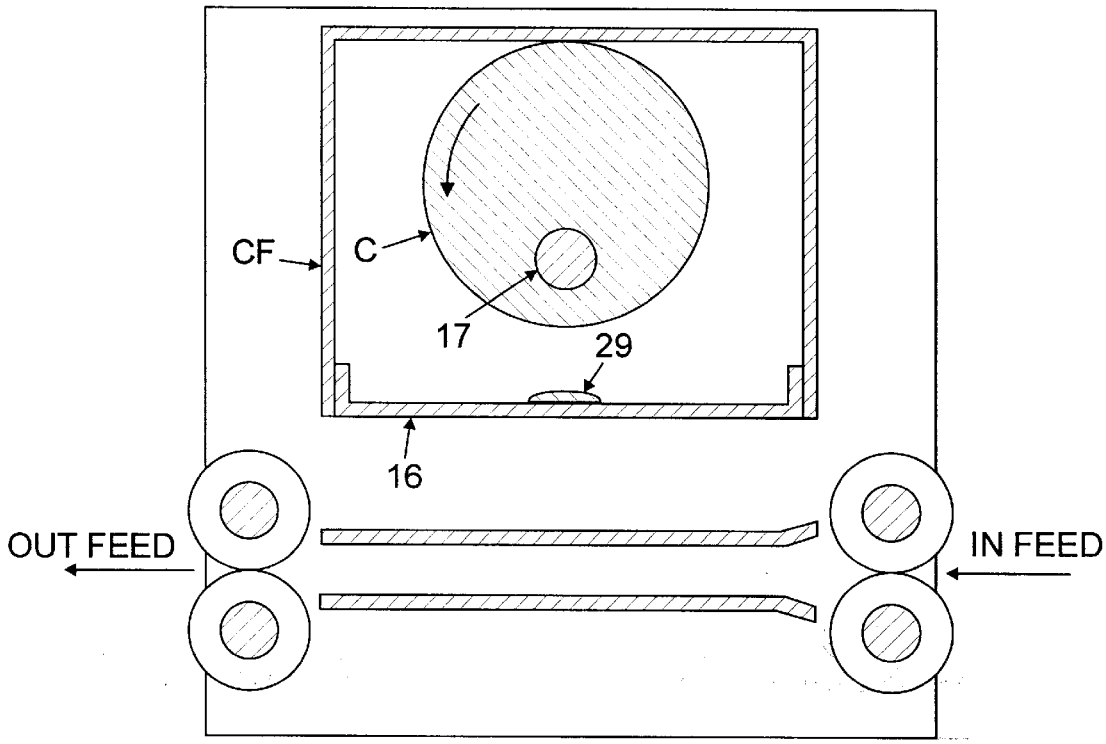
FIG. 3 is a vertical section on the line 3—3 of FIG. 1 showing the cams in an inactive position.
Figure 4:
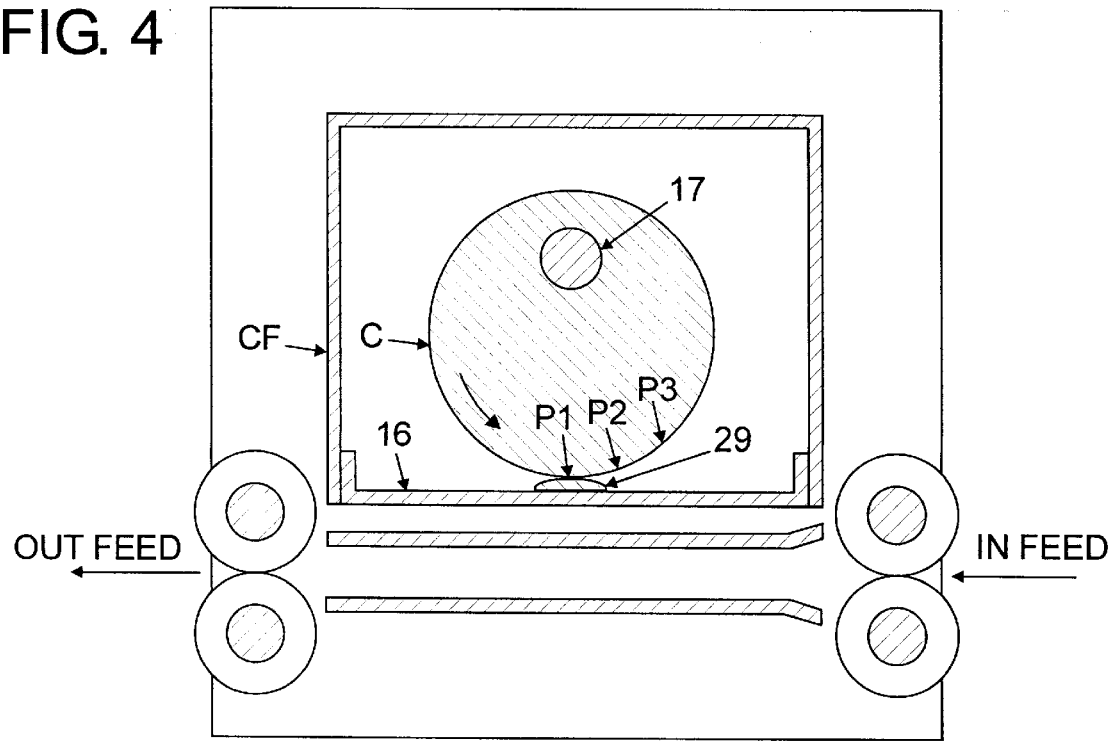
FIG. 4 is a view corresponding to FIG. 3, but showing the cam in an active position.

Referring now to FIGS. 3 and 4, it will be seen that the cam followers CF are shown as providing a box structure when interconnected with the punch support and pressure plate 16. It will also be seen that upon rotation of the cams C in the direction of the arrow the cam follower CF and the punch plate 16 travel through the throw of the cam between the position shown in FIG. 3 and the position shown in FIG. 4.

Preferably, each cam is adapted to ride upon a low friction material 29 so as to reduce frictional resistance as the cam is rotated to move the punch pressure and support plate 16 downwardly against the upward force of the spring 20 and to overcome the resistance of the paper sheet to the intrusion of the punches P1, P2 and P3.

As shown by the arrows applied to the cam in FIG. 4, also designated P1, P2 and P3, there are three active positions of the cam as it rotates, as will be hereinafter pointed out.

Figure 5:
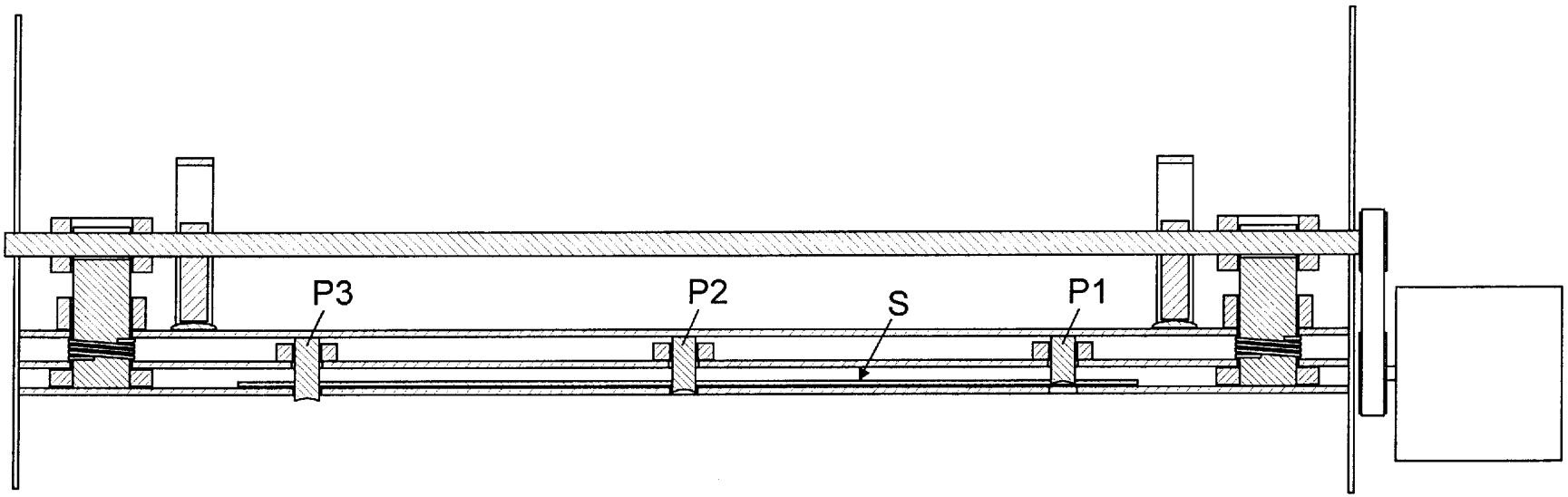
FIG. 5 is a longitudinal section on the line 5—5 of FIG. 1.

Referring to FIG. 5, the punches P1, P2 and P3 are of different lengths. As a result of such a structure, the punches progressively enter the sheet and into die holes or openings P1', P2' and P3' formed in die plate 24 to punch the holes therein in such a manner that punch P3 is the first punch in the progression and punch P3 has virtually removed the piece of paper from the hole P31 and punch P2 is in the die plate hole or opening P2' and has completely removed the material. Punch P1 is just entering the die plate P1'. This construction enables the drive to punch fairly thick papers and to be of relatively low power and relatively inexpensive.

In addition, the provision of the spring loading devices, at opposite ends of the shaft, permits the punch plate 16 to be provided with any selected number of punches, without addition to the spring force as a function of the number of punches. This is to say that there may be two, three, as shown, or more punches attached to the punch pressure plate.

Having thus described the structure on which a patent is sought, the invention will be described in the appended claims.

What is claimed is:

1. In an automatic punch for punching a plurality of holes in a sheet of paper fed thereto from a copying or printing machine, including means defining a sheet feed path for carrying a sheet through the punch, punching means spaced laterally of said feed paths means for camming said punching means to form punched holes in said sheet of paper, and means for spring loading said camming means to an inoperative position: the improvement wherein said punching means includes a plurality of punch elements movable by said means for camming, said means for camming including a pair of cams at opposite sides of said feed path, and said means for camming including a rotary drive shaft for rotating said pair of cams and wherein said punch elements are secured to said pressure plate, said pressure plate extending across said feed path, said means for camming acting upon said pressure plate, and including a die plate extending across said feed path and having die holes corresponding with said punch elements.

2. In an automatic punch for punching a plurality of holes as defined in claim 1, said punch elements being of progressively different lengths.

3. In an automatic punch for punching a plurality of holes in a sheet of paper fed thereto from a copying or printing machine, including means defining a sheet feed path for carrying a sheet through the punch, punching means spaced laterally of said feed path, means for camming said punching means to form punched holes in said sheet of paper, and means for spring loading said camming means to an inoperative position, the improvement wherein said punching means includes a plurality of punch elements movable by said means for camming, and said punch elements being of progressively different lengths.

* * * * *